United States Patent [19]

Peltz

[11] Patent Number: 4,876,811

[45] Date of Patent: Oct. 31, 1989

[54] HAND-HELD MESSAGE SIGN

[76] Inventor: David Peltz, 5766 N. Bel Aire Dr., Glendale, Wis. 53209

[21] Appl. No.: 157,706

[22] Filed: Feb. 19, 1988

[51] Int. Cl.[4] ..... G09F 21/02

[52] U.S. Cl. ..... 40/586; 40/642

[58] Field of Search ..... 40/586, 584, 591, 642, 40/643

[56] References Cited

U.S. PATENT DOCUMENTS

| | | | |
|---|---|---|---|
| 1,288,872 | 12/1918 | Gray | 40/586 |
| 2,134,300 | 10/1938 | Guberan | 40/586 |
| 2,691,837 | 10/1954 | Gove | 40/643 |
| 3,775,887 | 12/1973 | Precourt | 40/586 |
| 4,178,874 | 12/1979 | Berns et al. | 40/591 |

FOREIGN PATENT DOCUMENTS

| | | | |
|---|---|---|---|
| 707501 | 4/1965 | Canada | 40/586 |
| 3/349 | 8/1979 | European Pat. Off. | 40/586 |

*Primary Examiner*—Gene Mancene
*Assistant Examiner*—Wenceslao J. Contreras
*Attorney, Agent, or Firm*—Peter N. Jansson, Ltd.

[57] ABSTRACT

An improved hand-held sign for sending visual messages aimed at specific persons. The apparatus has a substantially vertical planar member for posting of messages, such as by message cards, a pistol-grip member with a handle portion and a substantially horizontal extension portion, the horizontal portion attached at its distal end to the back of the planar member. A plurality of message cards are preferably kept against the planar member.

19 Claims, 4 Drawing Sheets

HAND-HELD MESSAGE SIGN

FIELD OF THE INVENTION

This invention is related generally to signs and, more particularly, to hand-held signs for conveying a message to a specific person located at a distance from the message sender.

BACKGROUND OF THE INVENTION

The need frequently arises for a person to convey a simple and common message to someone who, while well within visual range and well within normal speaking range, may not easily and conveniently be reached with a spoken message because of particular circumstances. This occurs in many different situations.

One common example of adverse circumstances which frequently prevent normal spoken communication is driving in heavy traffic, such as on crowded freeways. Another is a noisy and crowded room. Still another is enclosure of one of the individuals within a glassed booth of some kind, such as a guardhouse or toll both. Still another example is a quiet room in which interruption of some activity is improper.

In such situations, people often decide to shout despite the problems this may cause and despite the usual problems or ineffectiveness of shouting. If they are able to restrain themselves from shouting an urgent message, whether genial or hostile, people sometimes resort to hand signals and gestures of one kind or another, or to attempting to convey these message by expressive but silent use of their mouths. And, in a few cases, signs are used to convey the message visually.

The use of signs in such situations often involves quickly scrawling some message on a piece of paper and then holding it in hand directly facing the intended message recipient. In some cases, permanent signs are held directly in hand, or supported by a device in some common way.

Certain hand-held signs of the prior art are not particularly well adapted to easy use while in a sitting position, particularly if in a space where there is little room for raising a sign. One example of such situation is use while sitting in an automobile. Certain hand-held signs are not easy to direct with emphasis at the intended recipient. Still others do not facilitate expression of the proper directed emotion if a message is intended to be conveyed with a particular feeling, whether of passion, thankfulness, anger, frustration, disgust, or simple emphasis.

Speed is very important in many situations in which hand-held signs are used. If the message display is late, it may be of no use or have less-than-desired effect. Quickly providing and displaying the appropriate message is a concern with certain prior hand-held signs. Another concern, in certain situations, is that the person holding the sign be shielded, that is, that the message itself be viewed rather than the hand of the holder.

The effective use of hand-held signs is made more difficult in the dark. Another concern is providing a lit display which is easy to use and does not interfere with other aspects of the operation of a hand-held sign.

There is a need for an improved hand-held sign which is particularly useful for certain situations and under certain circumstances such as those described above.

OBJECTS OF THE INVENTION

It is an object of this invention to provide an improved hand-held sign overcoming some of the problems and shortcomings with hand-held signs of the prior art.

Another object of this invention is to provide an improved hand-held sign for use under circumstances and conditions in which communication by speaking is impractical or improper.

Another object of this invention is to provide an improved hand-held sign which is particularly useful while sitting in a confined space.

Another object of this invention is to provide an improved hand-held sign which is particularly useful in communicating to drivers in traffic jams.

Yet another object of this invention is to provide an improved hand-held sign which facilitates transmission of a visual message with particular emphasis, emotion and/or direction.

Still another object of this invention is to provide an improved hand-held sign which better facilitates easy selection and display of a desired message.

Another object of this invention is to provide an improved hand-held sign which is easily useful at night when illumination of the message is necessary.

These and other important objects will be apparent from the descriptions of this invention which follow.

SUMMARY OF THE INVENTION

This invention is an improved hand-held message sign which overcomes some of the problems and shortcomings of the prior art, including those mentioned above.

The hand-held message sign of this invention includes a substantially vertical planar member having a front side and a back side, a pistol-grip member with a handle portion and a substantially horizontal extension portion having a distal end, and means attaching the distal end of the horizontal member to the back side of the planar member. The extension portion is preferably substantially normal to the planar portion.

The planar member is most preferably of sufficient size and the attachment of the extension portion and planar member properly positioned such that, in profile, all or substantially all of the pistol-grip member is positioned behind the planar member. In this way, the message which is conveyed is emphasized while the involvement of the person sending the message is deemphasized. This is the case even though the person sending the message is able to do so with substantial emotion of one kind or another directed at the intended recipient of the message.

In certain preferred embodiments, the attachment of the pistol-grip member to the vertical planar member is accomplished in a particular manner. The attachment means preferably includes a planar platelet which is affixed to the distal end of the extension portion in an orientation substantially parallel to the planar member, and means on the planar member engaging such platelet.

The platelet has an upper edge and opposed lateral edges for purposes of engagement with the vertical planar member. The vertical planar member, against which messages are posted, has means projecting from its back side which form grooves receiving the upper edge and the opposed lateral edges of the platelet. Such mating platelet and groove arrangement allows easy attachment and detachment of the pistol-grip member with the planar member. The groove-forming means most preferably is a retainer member forming an inverted U-shaped groove.

The hand-held message sign of this invention preferably has means for replaceably posting a message on the planar member so it may be seen from the front side. Such replaceable-posting means preferably includes a frame member attached to and spaced from the planar member and forming with the planar member a slot having an open edge. One or more message cards are held in the slot.

Most preferably, a plurality of message cards are kept within the slot, each card having an outer and an inner surface. Commonly-used messages are printed or otherwise placed permanently on the outer surfaces of such cards. One or more cards may be provided for customized messages as well. The outermost card is the one positioned to be viewed.

Each message card of the plurality of cards within the slot, including in particular those having messages placed permanently on their outer surfaces, has an edge which forms a tab portion. The tab portions of the several cards are offset from one another along the open edge. The tab of each card has printed on its inner side the same message as is printed boldly on the outer surfaces for viewing by a message recipient. Thus, the tabs serve to indicate to the message sender the messages readily available for sending. The tabs also provide a ready means for gripping a card to remove it and reinsert it in the slot in the outermost position where it is ready for viewing by the message recipient.

The slot for receiving and holding message cards is most preferably a vertical slot, having an open edge along the top of the frame member. Other arrangements, such as a side-open slot requiring insertion and removal of cards from the side, are possible.

Certain preferred embodiments include means secured with respect to the planar member for illuminating a message on the front side of the planar member. In such situations, a trigger switch adjacent to the handle portion of the pistol-grip member is preferably used for actuating the illuminating means.

The illuminating means preferably includes a light member which is positioned forward of the planar member and along such planar member, most preferably along one edge thereof. Placement along the lower edge is highly preferred. The light member preferably includes at least one electric light and at least one battery secured within the pistol-grip member to power the at least one light.

The light member also preferably includes a shield member which reflects light toward the front side of the planar member while shielding the message recipient from direct light transmission. This facilitates reading of the message.

DETAILED DESCRIPTIONS OF PREFERRED EMBODIMENTS

Figure 1:
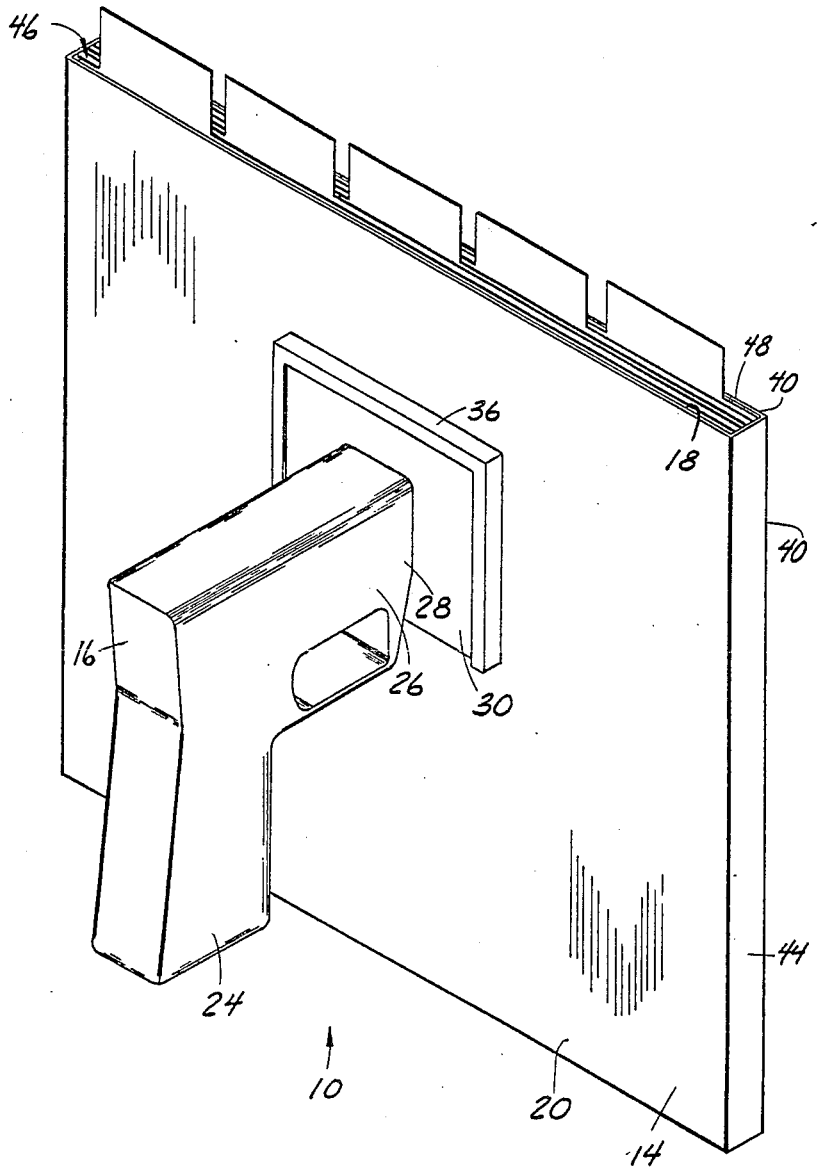
FIG. 1 is a perspective view of an improved hand-held message sign in accordance with this invention.
Figure 2:
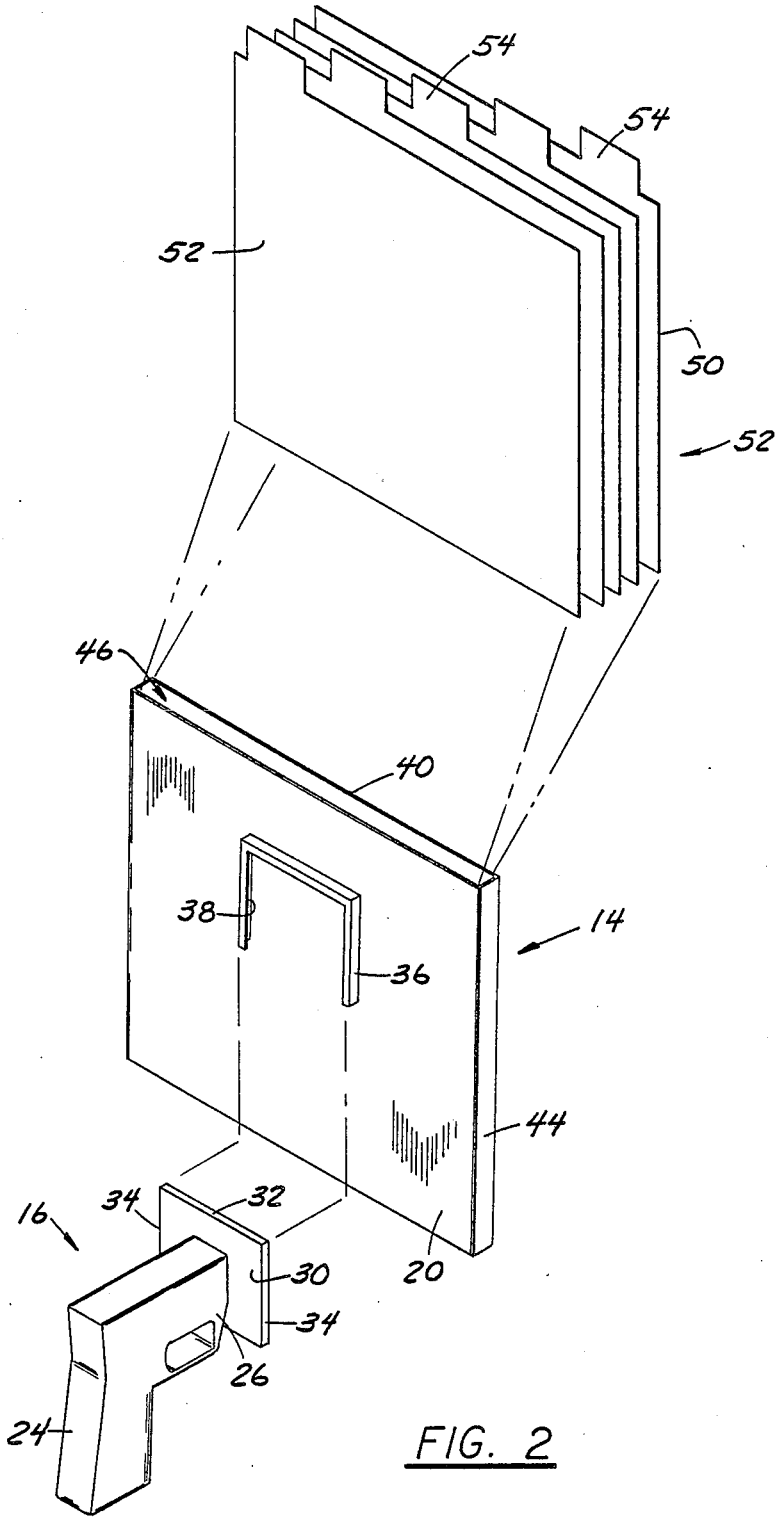
FIG. 2 is an exploded perspective view.
Figure 3:
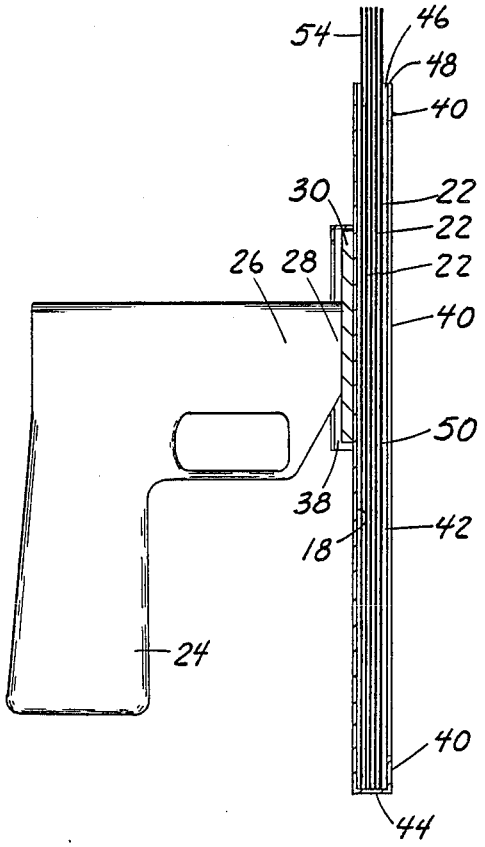
FIG. 3 is a side sectional view.
Figure 4:
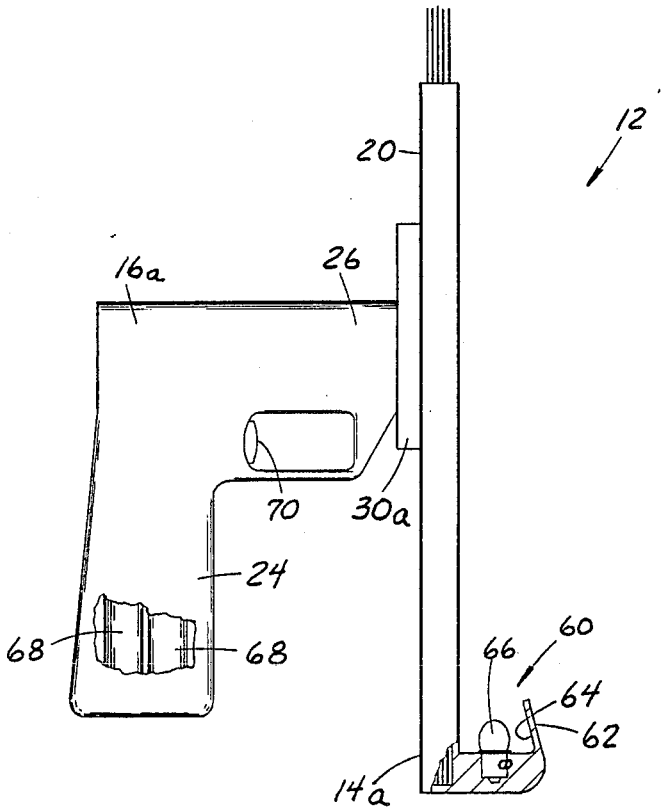
FIG. 4 is a side elevation of another embodiment of this invention, with breakaways to show parts of the device.

FIGS. 1–3 illustrate a hand-held message sign 10 in accordance with this invention, and FIG. 4 illustrates a hand-held message sign 12 which includes illumination means. Other than the devices relating to illumination, hand-held message sign 12 is in every respect like hand-held message sign 10. The same numerals are used for identical parts of the two devices.

Message sign 10 has a substantially vertical planar member 14 and a pistol-grip member 16 attached to planar member 14 and forming a means to hold the message sign. As used herein, the words "vertical" and "horizontal" refer to approximate orientations when message signs 10 and 12 are in their orientations of use.

Vertical planar member 14 has a front side 18 and a back side 20. Planar member 14 is rectangular in shape and supports message cards 22 as hereafter described. Pistol-grip handle member 16 includes a handle portion 24 and a substantially horizontal extension portion 26. Extension portion 26 extends from handle portion 24 to a distal end 28, where vertical planar member 14 is attached to pistol-grip member 16 by attachment means.

Extension portion 26 is normal to planar portion 14, that is, perpendicular thereto. Planar member 14 is of sufficient size and the attachment of extension portion 26 to planar portion 14 is positioned such that pistol-grip member 16 is entirely behind planar member 14. Thus, when viewing hand-held message sign 10 from front side 18 pistol-grip member 16 is entirely hidden by planar member 14. The profile of planar member 14 encompasses pistol-grip member 16.

The means by which pistol-grip member 16 is attached to planar member 14 includes a planar platelet 30 affixed to distal end 28 of extension portion 26. Platelet 30 is substantially parallel to vertical planar member 14 when pistol-grip member 16 and planar member 14 are attached. Platelet 30, as shown best in FIG. 3, includes an upper edge 32 and a pair of opposed lateral edges 34. Such edges project well beyond extension member 26.

A U-shaped retainer member 36 is affixed to back side 20 of planar member 14. Retainer member 36 is a three-sided frame forming an inverted U-shaped groove 38 which is sized to mate with upper edge 32 and lateral edges 34 of platelet 30. Thus, planar member 14 is removably attachable to pistol-grip member 16 simply by sliding its retainer member 16 over platelet 30, and pistol-grip member 16 may be separated from planar member 14 simply by sliding platelet 30 from retainer member 36.

A frame member 40 is attached to, in fact integrally formed with, planar member 14. Frame member 40 is itself planar, and it defines a rectangular opening 42 through which message cards 22 may be viewed. Frame member 40 is integrally attached to planar member 14 by means of a U-shaped edge 44 which extends along common bottom and lateral edges of frame member 40 and planar member 14. The bottom portion of U-shaped edge 44 provides a support for the lower edges of message cards 22.

Message cards 22 are larger in width and height than the width and height of opening 42, such that frame member 40 holds message cards 22 in place. The frame and edge structure just described forms with planar member 14 a slot 46 for message cards 22. Slot 46 includes an open edge 48 through which message cards 22 are inserted and removed. This structure provides a convenient means for replaceably posting a message on planar member 16 such that it may be seen from front side 18.

A plurality of message cards 22 are inserted into slot 46. Each message card 22 includes an outer surface 50 and an inner surface 52. Messages are printed on outer surfaces 50 in letters large enough to be seen by a message recipient who is positioned at a distance from hand-held message sign 10. The message on the outermost card is the message which may be seen, while the messages on the other cards can be seen selectively when such cards are placed in the outermost position.

Each message card 22 includes a tab portion 54 extending from its upper edge. Tab portions 54 serve two functions: First, they may be gripped for easy removal and reinsertion of a card from slot 46. Second, the message which is on each card, on the outer surface thereof, is also shown, or indicated in some way, on inner surface 52 at tab portion 54. Thus, the person holding message sign 10 may readily change messages without turning the device around and without removing and sorting through all of the cards.

Tab portions 54 of the several cards 22 are laterally offset from one another along open edge 48 of slot 46. This facilitates concurrent viewing of the available messages.

Turning now to FIG. 4, hand-held message sign 12 has a somewhat modified pistol-grip member **16*a* and a planar member 14*a* with additional elements attached to it. Attached to the lower edge of planar member 14*a* and in front of planar member 14*a* is a light member 60. Light member 60** extends along the planar member lower edge.

Light member 60 includes an elongated shield 62 having an inner reflecting surface 64. Light member 60 also includes a number of light bulbs 66, preferably small bulbs of the type used in flashlights. The positioning of light bulbs 66 and reflecting surface 64 directs light toward front side 18 of vertical planar member 14. More specifically, light member 60 illuminates a message on the frontmost card in slot 46.

Light bulbs 66 are electrically wired by wiring not shown to a source of power within pistol-grip member **16*a*. Such wiring includes contacts supported on platelet 30*a* and back side 20 of planar member 14*a*. Such electrical wiring extends through pistol-grip member 16*a* to batteries 68 supported within pistol-grip member 16*a*. Pistol-grip member 16*a* also includes a spring-biased trigger switch 70** which closes the electrical circuit when it is squeezed by the user's index finger and opens the electrical circuit when it is released.

The hand-held message signs of this invention may be made using a wide variety of materials and components. Suitable materials and parts and construction methods will be apparent to those skilled in the art.

A wide variety of means can be used for providing replaceable messages. For example, an electronic message board can be used on or as part of the vertical planar member, with customized messages made possible by electronic circuitry.

While the principles of this invention have been described in connection with specific embodiments, it should be understood clearly that these descriptions are made only by way of example and are not intended to limit the scope of the invention.

I claim:

1. A hand-held message sign comprising:

a substantially vertical planar message-bearing member having a message-bearing front side and a back side with a central portion;

a pistol-grip member with a handle portion and a substantially horizontal extension portion having a distal end; and means attaching the distal end of the horizontal member to the back side of the planar member in position thereon such that the pistol-grip member is behind the central portion whereby in use it is substantially occluded from view from the front by the message-bearing member.

2. The hand-held message sign of claim 1 wherein the extension portion is substantially normal to the planar portion.

3. The hand-held message sign of claim 2 wherein the planar member is of sufficient size and the attachment of the extension portion and planar member positioned such that in profile substantially all of the pistol-grip member is behind the planar member.

4. The hand-held message sign of claim 1 wherein the attachment means comprises:

a planar platelet affixed to the distal end of the extension portion and substantially parallel to the vertical planar member, the platelet having an upper edge and opposed lateral edges; and means projecting from the back side forming grooves receiving the upper edge and the opposed lateral edges, whereby the pistol-grip member is removably attached to the planar member.

5. The hand-held message sign of claim 4 wherein the groove-forming means comprises a retainer member forming an inverted U-shaped groove.

6. The hand-held message sign of claim 4 wherein the extension portion is substantially normal to the planar portion.

7. The hand-held message sign of claim 6 wherein the planar member is of sufficient size and the attachment of the extension portion and planar member positioned such that in profile substantially all of the pistol-grip member is behind the planar member.

8. The hand-held message sign of claim 1 further including means for replaceably posting a message on the planar member such that it may be seen from the front side.

9. The hand-held message sign of claim 8 wherein the replaceable-posting means comprises a frame member attached to and spaced from the planar member and forming therewith a slot having an open edge.

10. The hand-held message sign of claim 9 further comprising a message card within the slot.

11. The hand-held message sign of claim 9 further comprising a plurality of message cards within the slot, each card having an outer and an inner surface and an edge which forms a tab portion, the tab portions of the cards offset from one another along the open edge, whereby messages printed on the outer surfaces for viewing by a message recipient are indicated on the inner surfaces on the tab portions for viewing by the message sender.

12. The hand-held message sign of claim 9 wherein the slot is a vertical slot with the open edge along the top of the frame member.

13. The hand-held message sign of claim 12 further comprising a plurality of message cards within the slot, each card having an outer and an inner surface and an edge which forms a tab portion, the tab portions of the cards offset from one another along the open edge, whereby messages printed on the outer surfaces for viewing by a message recipient are indicated on the inner surfaces on the tab portions for viewing by the message sender.

14. The hand-held message sign of claim 13 wherein the extension portion is substantially normal to the planar portion.

15. The hand-held message sign of claim 14 wherein the planar member is of sufficient size and the attachment of the extension portion and planar member positioned such that in profile substantially all of the pistol-grip member is behind the planar member.

16. The hand-held message sign of claim 1 further comprising means secured with respect to the planar member for illuminating a message on the front side of the planar member.

17. The hand-held message sign of claim 16 further including a trigger switch adjacent to the handle portion for actuating the illuminating means.

18. The hand-held message sign of claim 17 wherein the illuminating means comprises:

a light member positioned forward of and along the planar member and including at least one electric light; and at least one battery secured within the pistol-grip member to power the at least one light.

19. The hand-held message sign of claim 18 wherein the light member further includes a shield member reflecting light toward the front side of the planar member and shielding a message recipient from direct light transmission.

* * * * *